United States Patent [19]

Heyraud

[11] Patent Number: 4,641,538

[45] Date of Patent: Feb. 10, 1987

[54] LIGHTWEIGHT ELECTRONIC TORQUE WRENCH

[75] Inventor: Georges Heyraud, Saint Just Malmont, France

[73] Assignee: Forges Stephanoises S.A., Saint-Etienne, France

[21] Appl. No.: 757,613

[22] Filed: Jul. 22, 1985

[30] Foreign Application Priority Data

Jul. 23, 1984 [FR] France ..... 84 11916

[51] Int. Cl.[4] ..... B25B 23/142

[52] U.S. Cl. ..... 73/862.26

[58] Field of Search ..... 73/862.21, 862.23, 862.26; 81/467, 477, 479

[56] References Cited

U.S. PATENT DOCUMENTS 3,995,477 12/1976 Almond ..... 73/862.23
4,006,629 2/1977 Barrett et al. ..... 73/862.26
4,125,016 11/1978 Lehoczky et al. ..... 73/862.23

FOREIGN PATENT DOCUMENTS 2538741 7/1984 France ..... 81/467

*Primary Examiner*—Charles A. Ruehl

*Attorney, Agent, or Firm*—Karl F. Ross; Herbert Dubno

[57] ABSTRACT

An electronic torque wrench has a rigid metallic sleeve of generally regular section extending along a tool axis and having a front end and an opposite handle end and a holder integrally formed with a flat rear part, a socket-like front part, and a flat web part interconnecting the rear and front parts. The flat rear part extends generally diametrically of the axis in the front end of the sleeve and has a pair of outer edges radially outwardly engaging the sleeve in surface contact. The front socket part is adapted to receive a wrench fitting engageable with the element to be torqued and is wholly out of contact with the sleeve. The flat intermediate web part interconnecting the front and rear parts extends diametrically of the axis and generally perpendicular to the rear part, has a pair of oppositely directed faces, and is wholly out of contact with the sleeve. This web part is substantially only capable of flexing perpendicular to itself and parallel to the rear part. A strain gauge on at least one face of the web part changes electrical characteristics, normally impedance, on flexing of the web part. Electronic circuitry connected to the strain gauge forms an output corresponding to the flexing of the web part and a display is provided to show this output.

6 Claims, 5 Drawing Figures

LIGHTWEIGHT ELECTRONIC TORQUE WRENCH

FIELD OF THE INVENTION

The present invention relates to a torque wrench. More particularly this invention concerns such a wrench incorporating electronic elements for measuring and displaying torque.

BACKGROUND OF THE INVENTION

A standard electronic-type torque wrench has a rigid elongated body having a tool end carrying a socket-type holder adapted to be rotationally fixed to a part to which a predetermined torque is to be applied and an opposite handle end. This holder has a front end that normally carries a fitting engaged over the nut or bolt being torqued, a rear end solidly lodged in the front end of the tubular body, and a small-diameter neck or web extending between them dimensioned so that it can flex. Transducers including strain gauges are carried on the neck of the holder and generate an actual value output corresponding to the actual torque being applied by the wrench to the part rotationally coupled to the tool end. A display carried on the wrench is connected to the transducers to show this actual torque. The body of such a tool is typically of cylindrical shape, and the various circuit elements are housed within this body.

Since such a wrench must be able to exert considerable torque, the body must be made fairly heavy and rugged. As a result the tool is heavy and often fairly bulky to hold and use.

In addition it is often the case that whatever fitting is mounted in the holder of the body does not sit squarely on the bolt or nut being torqued, so that the entire tool is twisted somewhat rather than simply moved purely angularly of the axis of the part being torqued. The same problem occurs when the user cannot position himself or herself properly when using the device, so that it is flexed transversely of the bolt axis. The strain gauges fixed on the holder respond to this transverse flexing of the holder and give false readings.

OBJECTS OF THE INVENTION

It is therefore an object of the present invention to provide an improved electronic torque wrench.

Another object is the provision of such an electronic torque wrench which overcomes the above-given disadvantages, that is which is relatively light and sturdy, and which does not respond to parasitic transverse flexing.

SUMMARY OF THE INVENTION

An electronic torque wrench according to the invention has a rigid metallic sleeve of generally regular section extending along a tool axis and having a front end and an opposite handle end and a holder integrally formed with a flat rear part, a socket-like front part, and a flat web part interconnecting the rear and front parts. The flat rear part extends generally diametrally of the axis in the front end of the sleeve and has a pair of outer edges radially outwardly engaging the sleeve in surface contact. The front socket part is adapted to receive a wrench fitting engageable with the element to be torqued and is wholly out of contact with the sleeve. The flat intermediate web part interconnecting the front and rear parts extends diametrally of the axis and generally perpendicular to the rear part, has a pair of oppositely directed faces, and is wholly out of contact with the sleeve. This web part is substantially only capable of flexing perpendicular to itself and parallel to the rear part. A strain gauge on at least one face of the web part changes electrical characteristics, normally impedance, on flexing of the web part. Electronic circuitry connected to the strain gauge forms an output corresponding to the flexing of the web part and a display is provided to show this output.

The tight fit between the complementary outer surfaces of the rear-part edges and the inner surface of the sleeve ensures that the holder will not loosen with time in the sleeve. The region of surface contact can have an important axial dimension to further increase the solidity of the interconnection of this rear part and the sleeve. As a result the sleeve can be relatively thin-walled to make the tool as light as possible, with no loss in strength.

According to another feature of this invention the sleeve is of substantially elliptical section having a major-axis plane generally perpendicular to the web part and parallel to the rear part. This shape is extremely strong, as the relatively flat walls of the tube can withstand considerable force. In addition the flat upper face can easily carry the display and input device for the electronic circuitry. Furthermore the rear part has a width measured perpendicular to the axis and in the plane and a length measured axially and equal to more than the width so that the rear part is very solidly integrated with the sleeve. The handle end is formed with transverse grooves or flutes that make gripping it easier. The tool is extremely comfortable to grip, and naturally discourages applying to it any force not in the major-axis plane.

A screw is engaged perpendicular to the plane through the sleeve in the rear part and securing the holder in the sleeve. The rear part has a pair of flat faces spaced from and generally flanking the plane and the circuitry includes a flat circuit board secured by the screw to one of the faces of the rear part and extending generally parallel to but offset from the plane to subdivide the sleeve into a relatively large compartment and a relatively small compartment. The board thus has a width measured parallel to the plane substantially smaller than the inner diameter of the sleeve at the plane. Circuit elements on the board are easily accommodated in the large compartment.

The front part according to this invention has a front end of circular shape centered on the axis and a rear end of elliptical shape aligned with the sleeve, and tapers from the front end to the rear end. Thus the most stressed regions of the front part are reinforced.

DESCRIPTION OF THE DRAWING

The above and other features and advantages will become more readily apparent from the following, reference being made to the accompanying drawing in which.

SPECIFIC DESCRIPTION

Figure 1:
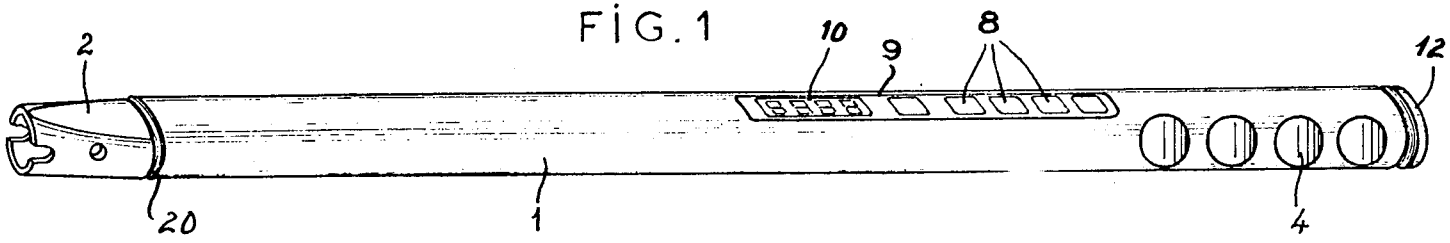
FIG. 1 is a perspective view of the torque wrench according to this invention.
Figure 5:
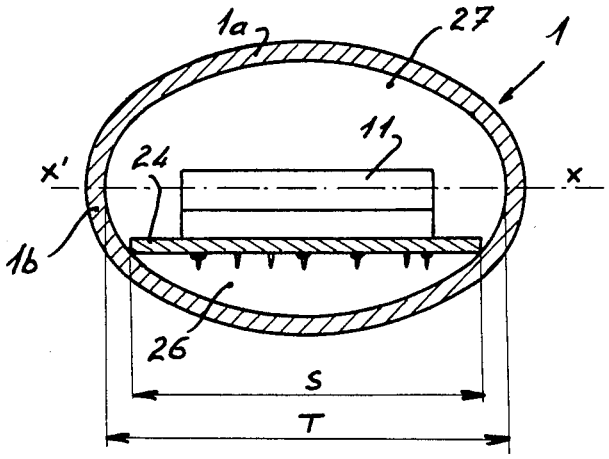
FIG. 5 is a large-scale cross section through the wrench.

As seen in FIG. 1 the wrench according to this invention has an elongated elliptical-section sleeve housing 1 having a front end holder 2 adapted to receive a fitting 3 such as the illustrated box wrench, and an opposite end 4 that is transversely fluted to afford a good grip for the hand. This sleeve housing 1 is tubular as seen in FIG. 5, having upper and lower broad walls 1*a* flanking a plane x-x' lying on the major axis of its elliptical shape and two side walls 1*b* of a smaller radius r of curvature. The top wall 1*a* is formed with a recess 7 itself formed with a hole 6 and accommodating a face plate 9 carrying four input buttons 8 and an eight-digit numeric display 10 both carried on a flat printed circuit board 24 also carrying various circuit elements 11. Reference should be made to my copending and jointly filed application Ser. No. 757,614 for more details regarding this circuitry. The rear end of the housing 1 is sealed by a cap 12 carrying a holder 13 in which is fitted a battery 14 that powers the device.

Figure 4:
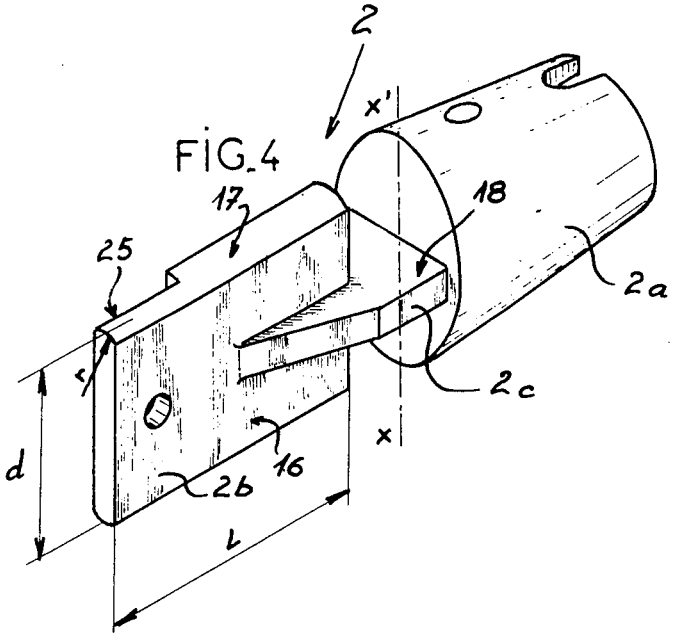
FIG. 4 is a large-scale perspective view of a detail of the wrench of this invention.

The holder 2 according to this invention and as best seen in large scale in FIG. 4 is unitarily formed of metal and comprises a front socket part 2*a*, a rear base part 2*b*, and an intermediate web part 2*c* interconnecting the parts 2*a* and 2*b*. The front part 2*a* is formed centered on the axis of the tool with a cylindrical blind bore 15 and is provided with spring-loaded balls that hold the fitting 3 in place. This front part is circular at its front end and elliptical at its rear end which is axially spaced slightly forward of the extreme front end of the housing 1 which is of uniform elliptical section in front of the transversely fluted rear end 4. The elliptical rear end of the front part 2*a* is of the same shape and size as the sleeve 1 and is identically oriented on the major axis x'-x thereof, but lies wholly out of contact with the sleeve 1. A highly elastic O-ring seal 20 engaged axially between the front part and the sleeve 1 transmits no force; it serves only to keep dust and the like out of the interior of the tool.

The rear part 2*b* is basically formed of a flat plate having a pair of planar opposite faces 16 parallel to each other and symmetrically flanking the plane x'-x and a pair of curved edges 17 of the same radius r of curvature as the side walls 1*b*. The width d of the rear part 2*b* corresponds to the interior width T at the plane x'-x of the sleeve 1 as seen in FIG. 5. The length L of the part 2*b* forms with the width d a ratio L:d at least equal to 1, here equal to 1.5. This ensures extremely solid anchoring of the holder 2 in the sleeve 1.

Figure 2:
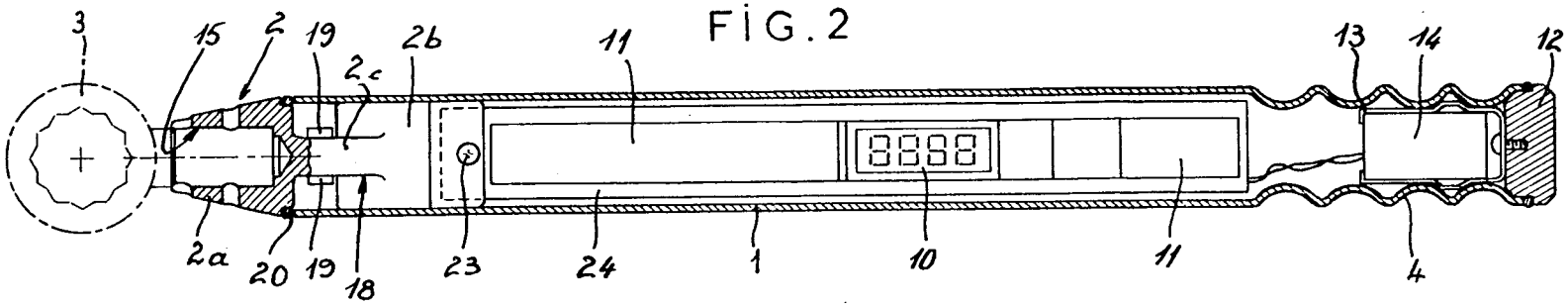
FIG. 2 is an axial section through the wrench of FIG. 1.
Figure 3:
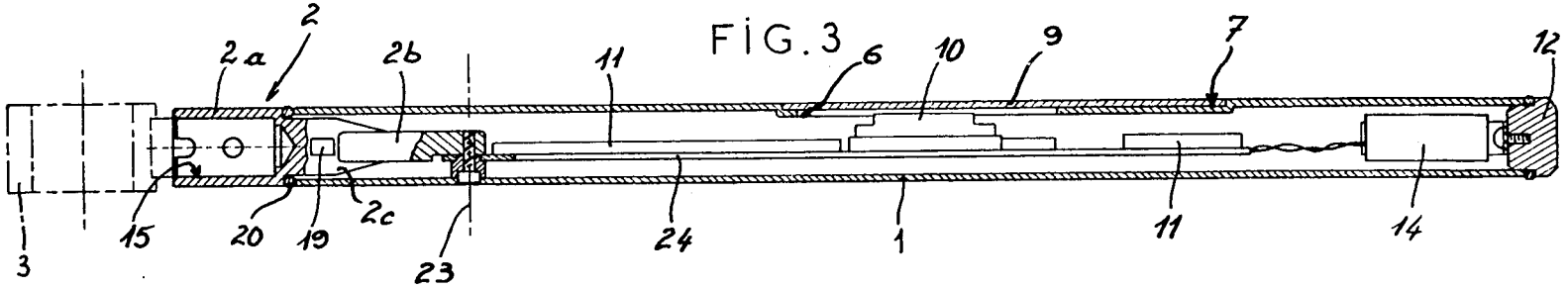
FIG. 3 is another axial section through the wrench of FIG. 1 but taken in a plane perpendicular to the section plane of FIG. 2.

The integral web part 2*c* is flat and has a pair of parallel opposite faces 18 symmetrically flanking the tool axis and perpendicular to the plane x'-x. These faces 18 carry as shown in FIGS. 2 and 3 respective strain gauges 19 connected to the circuitry 11. Since the width of the web 2*c* measured perpendicular to the plane x'-x is more than three times its thickness measured perpendicular thereto, flexing of this web 2*c* perpendicular to this plane x'-x is almost impossible. On the other hand flexing of this web 2*c* in the plane x'-x is substantially easier, and it is this flexing that the gauges 19 will respond to.

One of the faces 16 is cut out at 25 to receive the end of the rectangular printed-circuit board 24. A screw 23 extending through the lower wall 1*a* and through a spacer underneath this board 24 both secures the board 24 to the holder 2 and secures the board 24 and holder 2 in the sleeve 1. As seen in FIG. 5, this positions the board 24 parallel to but well below the plane x'-x, so that the board can only have a width S which is somewhat smaller than the inner major dimension T of the sleeve 1. The board 24 therefore subdivides the interior of the sleeve 1 into a relatively small lower compartment 26 and a larger upper compartment 27. Only the tips of the circuit elements poking through the board 24 need be accommodated in the lower compartment 26. The upper compartment 27 receives the circuit elements 11 as well as the display 10, which are somewhat larger.

The tool according to this invention can be quite light, as the shape of the sleeve 1 with its wide and fairly flat walls 1*a* gives it great resistance to bending in the plane x'-x, which is the direction it is stressed in. Thus it is possible to use a fairly small wall thickness for the tubular housing 1, allowing the overall weight of the device to be minimized.

Assembly and servicing of the device are also extremely easy as a single screw 23 holds all the parts in place. For assembly the entire core of the device and the holder 2 are just pushed back into the sleeve 1 from the front end and are secured in place by the screw 23. The battery connections can be made later.

Furthermore, the device will not be able to bend appreciable except in the plane x'-x, and in any case the gauges 19 will not respond to any other bending anyhow. Thus the tool can be counted on to give accurate readings, even if being twisted or canted when used.

I claim:

1. An electronic torque wrench comprising:

a rigid metallic sleeve of generally regular section extending along a tool axis and having a front end and an opposite handle end;

a holder integrally formed with a flat rear part extending generally diametrally of the axis in the front end of the sleeve and having a pair of outer edges radially outwardly engaging the sleeve in surface contact, a front socket part adapted to receive a wrench fitting engageable with the element to be torqued and wholly out of contact with the sleeve, and a flat intermediate web part interconnecting the front and rear parts, extending diametrally of the axis and generally perpendicular to the rear part, having a pair of oppositely directed faces, and wholly out of contact with the sleeve, the web part being substantially only capable of flexing perpendicular to itself and parallel to the rear part;

a strain gauge on at least one face of the web part, whereby flexing of the web part varies the electrical characteristics of the strain gauge;

electronic circuitry connected to the strain gauge for forming an output corresponding to the flexing of the web part; and means for displaying the output.

2. The electronic torque wrench defined in claim 1 wherein the sleeve is of substantially elliptical section having a major-axis plane generally perpendicular to the web part and parallel to the rear part.

3. The electronic torque wrench defined in claim 2, further comprising a screw engaged perpendicular to the plane through the sleeve and the rear part and securing the holder in the sleeve.

4. The electronic torque wrench defined in claim 3 wherein the rear part has a pair of flat faces spaced from and generally flanking the plane and the circuitry includes:

a flat circuit board secured by the screw to one of the faces of the rear part and extending generally parallel to but offset from the plane to subdivide the sleeve into a relatively large compartment and a relatively small compartment, the board having a width measured parallel to the plane substantially smaller than the inner diameter of the sleeve at the plane; and circuit elements on the board in the large compartment.

5. The electronic torque wrench defined in claim 2 wherein the front part has a front end of circular shape centered on the axis and a rear end of elliptical shape aligned with the sleeve, and tapers from the front end to the rear end, whereby the most stressed regions of the front part are thereby reinforced.

6. The electronic torque wrench defined in claim 2 wherein the rear part has a width measured perpendicular to the axis and in the plane and a length measured axially and equal to more than the width.

* * * * *